US005882268A

United States Patent [19]

McIntosh et al.

[11] Patent Number: 5,882,268

[45] Date of Patent: *Mar. 16, 1999

[54] GOLF CLUB AND SHAFT THEREFOR

[75] Inventors: William R. McIntosh, Bartlett; Jeffrey E. Kitchens, Cordova, both of Tenn.

[73] Assignee: True Temper Sports, Inc., Wilmington, Del.

[ * ] Notice: The term of this patent shall not extend beyond the expiration date of Pat. No. 5,634,860.

[21] Appl. No.: 615,353

[22] Filed: Mar. 13, 1996

[51] Int. Cl.[6] ..... A63B 53/10

[52] U.S. Cl. ..... 473/316; 473/319

[58] Field of Search ..... 473/316, 317, 473/318, 319, 320, 321, 322, 323, 559, 567, 544; 273/DIG. 7, DIG. 23

[56] References Cited

U.S. PATENT DOCUMENTS

| | | | |
|---|---|---|---|
| 1,486,572 | 3/1924 | Forsyth . | |
| 1,688,473 | 10/1928 | Sippel . | |
| 1,781,116 | 11/1930 | Link et al. . | |
| 1,796,274 | 3/1931 | Bryant . | |
| 1,980,031 | 11/1934 | Brading . | |
| 1,997,853 | 4/1935 | Buhrke . | |
| 2,124,534 | 7/1938 | Barnhart . | |
| 2,153,550 | 4/1939 | Cowdery . | |
| 4,097,626 | 6/1978 | Tennant . | |
| 4,132,579 | 1/1979 | Vanauken | 273/DIG. 23 |
| 4,415,156 | 11/1983 | Jorgensen . | |
| 5,251,896 | 10/1993 | Gerlach . | |
| 5,265,872 | 11/1993 | Tennant . | |
| 5,277,423 | 1/1994 | Artus . | |
| 5,294,119 | 3/1994 | Vincent . | |
| 5,297,791 | 3/1994 | Negishi . | |
| 5,316,299 | 5/1994 | Feche et al. . | |
| 5,551,691 | 9/1996 | Harada et al. | 473/323 |
| 5,620,380 | 4/1997 | Tennent et al. | 473/319 |
| 5,634,860 | 6/1997 | McIntosh | 473/318 |

FOREIGN PATENT DOCUMENTS 254121 of 1995 Taiwan .

*Primary Examiner*—Sebastiano Passaniti
*Attorney, Agent, or Firm*—J. Bruce Hoofnagle

[57] ABSTRACT

A golf club 10 includes a shaft 12 with a grip 18 assembled on a butt end 20 of the shaft. A club head 22 is mounted on a tip end 24 of the shaft 12. The shaft 12 is composed of a non-metallic material, such as fibers in a cured plastic matrix, and is formed with an tapered intermediate section 26. The section 26 includes two segments 28 and 30 which taper at different taper rates. A bulge 32 is formed in the shaft 12 near an inboard extremity of the tip end 24. The bulge 32 is formed with a central cylindrical section 34 and transition sections 36 and 38 on opposite axial ends of the central section. The diameter of the bulge 32 at any cross section thereof is greater than the diameter of the immediately adjacent portions of the shaft 12. Also, the bulge 32 is formed with an axial opening 16, the diameter of which is less than the diameter of the immediately adjacent portions of the shaft 12.

18 Claims, 4 Drawing Sheets

GOLF CLUB AND SHAFT THEREFOR

BACKGROUND OF THE INVENTION

This invention relates to a golf club and a shaft therefor and particularly relates to a golf club and a shaft therefor having structure which increases the opportunity for making clubs of lighter weight with enhanced flexibility and torsional characteristics.

Golfing is a world wide sport with increasing popularity. With the increase in the golfing population, there is a significant increase in the number of players with a discerning demand for golf clubs which will improve and enhance their playing of the game. This demand goes well beyond those who play professionally and those in the upper levels of the amateurs.

Typically, some of the aspects of concern for the discerning golfer are the weight of the club, a balance between the flexibility and the stiffness of the shaft, and the torsional character of the shaft. Golfers usually prefer a light-weight club for obvious reasons. However, the flexibility and torsional requirements vary amongst golfers and relate to the golfer's "feel" of the club when the club is swung and upon impact with the ball.

In an effort to provide golf clubs which generally address the concerns noted above, many designs of shaft configuration and composition have evolved over the years. Some of these designs involve the placement of an enlargement in a selected portion of the shaft to, in effect, divide the shaft into two sections. One example of this premise regarding metal shafts is disclosed in U.S. Pat. No. 2,050,554 which issued on Aug. 11, 1936. An example of such structure in a composite or non-metallic shaft is disclosed in United Kingdom Patent No. GB 2,250,443 which issued on Aug. 24, 1994.

While golf clubs having shafts with a variety of such enlargement designs have been effective, there is a continuing demand and need for further improvement in this aspect of shaft design.

In addition, each club within a set of clubs typically has parameters which are different from the parameters of the other clubs in the set. For example, the club length, club weight, head configuration and other club parameters of each of the clubs of a set is different from the same parameters of the other clubs in the set. This equates to a different Moment-of-Inertia and different torsional requirement for each club with respect to each of the other clubs of the set. Therefore, each time the golfer uses a different club from the set in the normal playing of the game of golf, the golfer experiences different reactions from the swinging of the various clubs of the set which could affect the consistency in the golfer's playing of the game.

In view of this potential inconsistency, there is a need to balance or match the clubs of a set so that torsional stability of each club is normalized with respect to the other clubs of the set and the reaction realized by the golfer is somewhat consistent from club to club of the set.

SUMMARY OF THE INVENTION

It is, therefore, an object of this invention to provide a golf club, and a shaft therefor, with improved characteristics leading to enhanced playing of the game of golf by the users of a club employing such a shaft.

Another object of this invention is to provide a golf club shaft which is sectionalized to enhance performance characteristics of a golf club which employs such a shaft.

Still another object of this invention is to provide a shaft which is adaptable for use with the different clubs of a set to provide general uniformity and matching in the torsional characteristics of the different clubs and thereby enhance a golfers opportunity to play the game of golf within the normal ability of the golfer.

With these and other objects in mind, this invention contemplates a golf club shaft which includes a body composed of a non-metallic material extending longitudinally along an axis of the body. The body is formed with a butt end at one end of the body and has an inboard extremity of a prescribed diameter and an outboard extremity. The body is further formed with a tip end at an end of the body axially opposite the butt end and spaced axially therefrom wherein the tip end has an inboard extremity of a diameter less than the prescribed diameter and an outboard extremity. In addition, the body is formed with an intermediate section which extends between the inboard extremities of the butt end and the tip end. The diameter of an end of the intermediate section which joins the butt end is the same as the prescribed diameter and the diameter of an end of the intermediate section which joins the tip end is the same as the diameter of the inboard extremity of the tip end. The body is formed with a bulge along the axis and includes a central section with transition sections at opposite ends of the central section which join the central section with the adjacent portions of the shaft. The bulge is formed with a circular axial opening therethrough having a straight wall extending generally in an axial direction. The bulge is further formed with an external size greater than the external size of adjacent portions of the shaft.

This invention further contemplates a golf club which embodies the shaft contemplated above in combination with a grip assembled on the butt end of the shaft and a club head assembled on the tip end of the shaft.

Other objects, features and advantages of the present invention will become more fully apparent from the following detailed description of the preferred embodiment, the appended claims and the accompanying drawings.

DETAILED DESCRIPTION OF THE INVENTION

Figure 1:
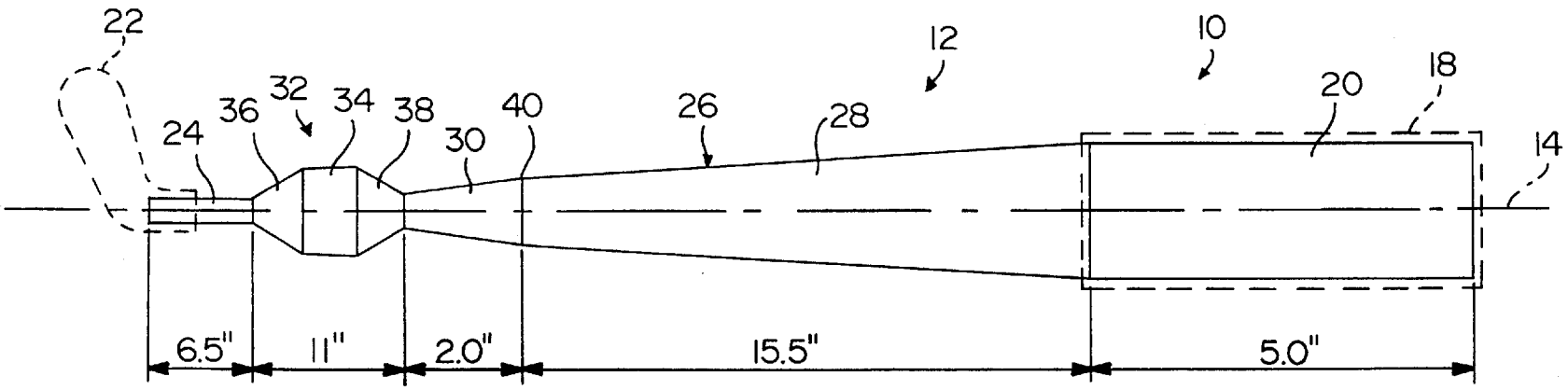
FIG. 1 is a side view showing a golf club including a shaft with a bulge in accordance with certain principles of the invention.

As shown in FIG. 1, a golf club 10 includes a shaft 12 which is formed in a configuration of a hollow body or tube having a longitudinal axis 14 and composed of a composite material 15 (FIGS. 2 and 3) which includes non-metallic fibers carried in a cured plastic matrix. The shaft 12 is formed with an axial opening 16 (FIG. 2) therethrough. The club 10 further includes a grip 18, shown in phantom, assembled on a cylindrical butt end 20 of the shaft 12 and a club head 22, shown in phantom, mounted on a cylindrical tip end 24 of the shaft. The shaft 12 is also formed with an intermediate section 26 between the butt end 20 and the tip end 24. It is noted that the exterior surfaces of the butt end 20 and the tip end 24 are preferably cylindrical as illustrated, but either or both ends could be tapered without departing from the spirit and scope of the invention. The intermediate section 26 of the shaft 12 is composed of two segments 28 and 30 which extend along the axis 14.

Figure 2:
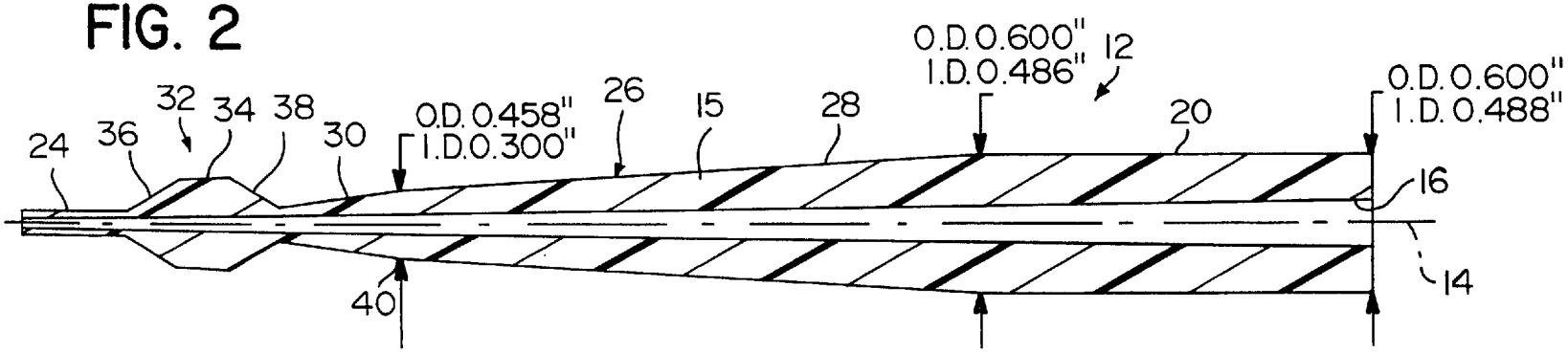
FIG. 2 is a sectional view showing the shaft of FIG. 1 and the bulge in accordance with certain principles of the invention.
Figure 3:
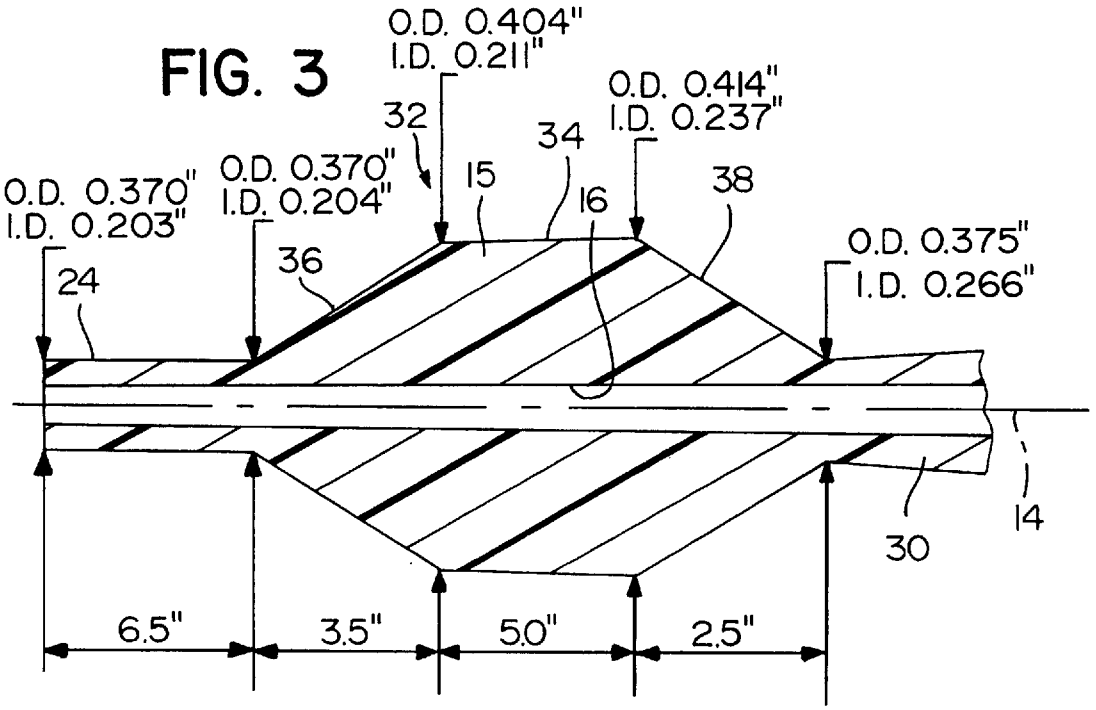
FIG. 3 is a sectional view showing the bulge of FIGS. 1 and 2 in accordance with certain principles of the invention.

In the preferred embodiment of the invention as shown in FIGS. 1 and 2, a bulge 32 is formed in the shaft 12 and is located between, and joined to, the segment 30 at one axial end of the bulge and to the tip end 24 at the opposite axial end of the bulge. Referring to FIGS. 1, 2 and 3, the bulge 32 is formed with a central cylindrical section 34 and two transitional sections 36 and 38 each of which are joined at one axial end thereof to the central section and to an opposite axial end to the segment 30 and the tip end 24, respectively.

The length, outside diameter (O.D.) and inside diameter (I.D.) dimensions and the structural configurations of the shaft 12, and the axial location of the bulge 32, of FIGS. 1, 2 and 3 depict the preferred embodiment of the invention. Other length and diameter dimensions and structural configurations of the shaft 12, and axial locations of the bulge 32, can be used without departing from the spirit and scope of the invention.

Also in the preferred embodiment, the shaft 12 is composed of non-metallic fibers, such as graphite fibers, and a cured plastic matrix, such as a cured epoxy resin which carries the fibers therein. The fibers could be formed from fiberglass, aramid, boron or other suitable non-metallic fiber materials, and the epoxy resin matrix could be polyester, vinylester, nylon or any other suitable thermoset or thermoplastic matrix, all without departing from the spirit and scope of the invention.

Further, in the preferred embodiment, the axial opening 16 is formed with a wall which is straight and uniformly tapered as illustrated in FIG. 2. As further shown in FIG. 2, and as noted above, the exterior surface of the butt end 20 and the tip end 24 are cylindrical in shape and the segment 28 is formed at a first uniform taper and the segment 30 is formed at a second uniform taper. Segments 28 and 30 are joined at a juncture 40 along the intermediate section 26 at the prescribed location as indicated by the length dimensions in FIG. 1. It is noted that the intermediate section 26 of the shaft 12 could be formed with a uniform taper between the inboard extremities of the butt end 20 and the bulge 32, rather than with the segments 28 and 30, without departing from the spirit and scope of the invention. The dimensions illustrated in FIG. 1 show the various locations of the portions of the shaft 12 relative to each other. These dimensions could be varied without departing from the spirit and scope of the invention.

Referring to FIG. 3, the structural configuration of the preferred embodiment of the bulge 32 is depicted by the various dimensions as illustrated. Further, the bulge 32 is composed of the composite material 15 which extends radially outward from the wall of the axial opening 16 in the preferred embodiment of the invention. The contour of the bulge 32 follows the prescribed tapers of the transitional sections 36 and 38 at opposite ends thereof and the generally cylindrical exterior of the central section 34. Thus, except for the axial opening 16, the composite material 15 of the bulge 32 in the preferred embodiment of the invention occupies the entire volume defined between the wall of the axial opening and the exterior contour of the bulge.

The particular arrangement of the elements of the bulge 32 provide structural features of the shaft 12 which enhance the performance characteristics of the shaft when the shaft forms a portion of the golf club 10. By placement of the bulge 32 as illustrated in FIG. 1, the center of gravity of the club 10 is located closer to the tip end 24 of the shaft 12 than it would normally be in a bulgeless shaft. This feature permits the use of lighter weight club heads in the assembly of a finished golf club.

Figure 4:
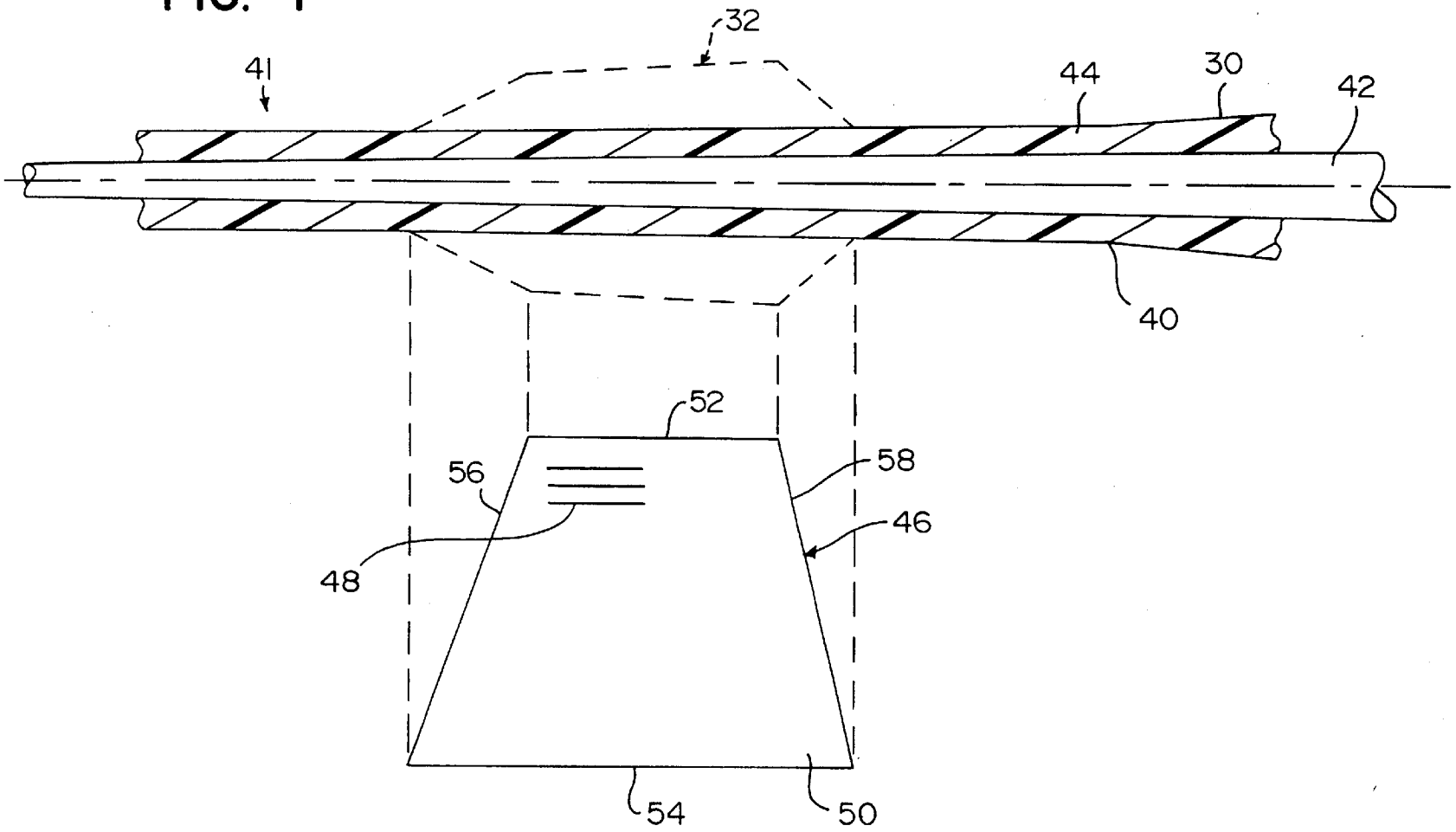
FIG. 4 is a diagrammatical view showing one technique for forming the bulge of FIG. 1.

Referring to FIG. 4, in one technique for making the shaft 12, a subassembly 41 is formed by wrapping a plurality of sheets (not shown) of composite material around a mandrel 42 to form a composite pack 44 of the composite material on the mandrel. Each sheet of composite material includes a plurality of non-metallic fibers, such as graphite fibers, carried in an uncured plastic matrix, such an epoxy resin matrix. The fibers are spaced, parallel and are arranged in any of several conventional orientation patterns in a manner well known in the manufacture of composite shafts. Thereafter, a sheet 46 of the composite material, composed of fibers 48 carried in an uncured plastic matrix 50, is formed in the configuration illustrated in FIG. 4. As shown, the sheet 46 is formed with a shorter end 52 spaced from a longer opposite end 54 and tapered sides 56 and 58. Also, the fibers 48 are spaced and parallel with respect to each other and are parallel with the ends 52 and 54 of the sheet 46, and extend between the sides 56 and 58 thereof. It is noted that other shapes of the sheet 46, and other orientations of the fibers 48 could be employed to form a bulge without departing from the spirit and scope of the invention.

The sheet 46 is then wrapped around the subassembly 41 to form the wrapping which will eventually form the bulge 32, the outline of which is represented in FIG. 4 in dotted lines. Thereafter, a heat shrinkable film (not shown) is wrapped around the subassembly 41 and the assembled sheet 46 to form an assembly. In the assembly, the sheets of composite material, including the sheet 46, are compactly captured between the mandrel 42 and the heat shrinkable film. The assembly is then placed in a heated environment whereby the uncured plastic matrix of each sheet liquifies and blends generally with the plastic of the other sheets while the various fibers maintain generally their assembled orientation. Also, the heat shrinkable film shrinks to confine the captured composite material to a desired shape. The assembly is removed from the heated environment and is cooled whereby the blended plastic is cured in a solid form. The heat shrinkable film is removed and the mandrel 42 is separated axially from the cured product to reveal the shaft 12 which may be processed through external sizing and surface finishing operations.

Figure 5:
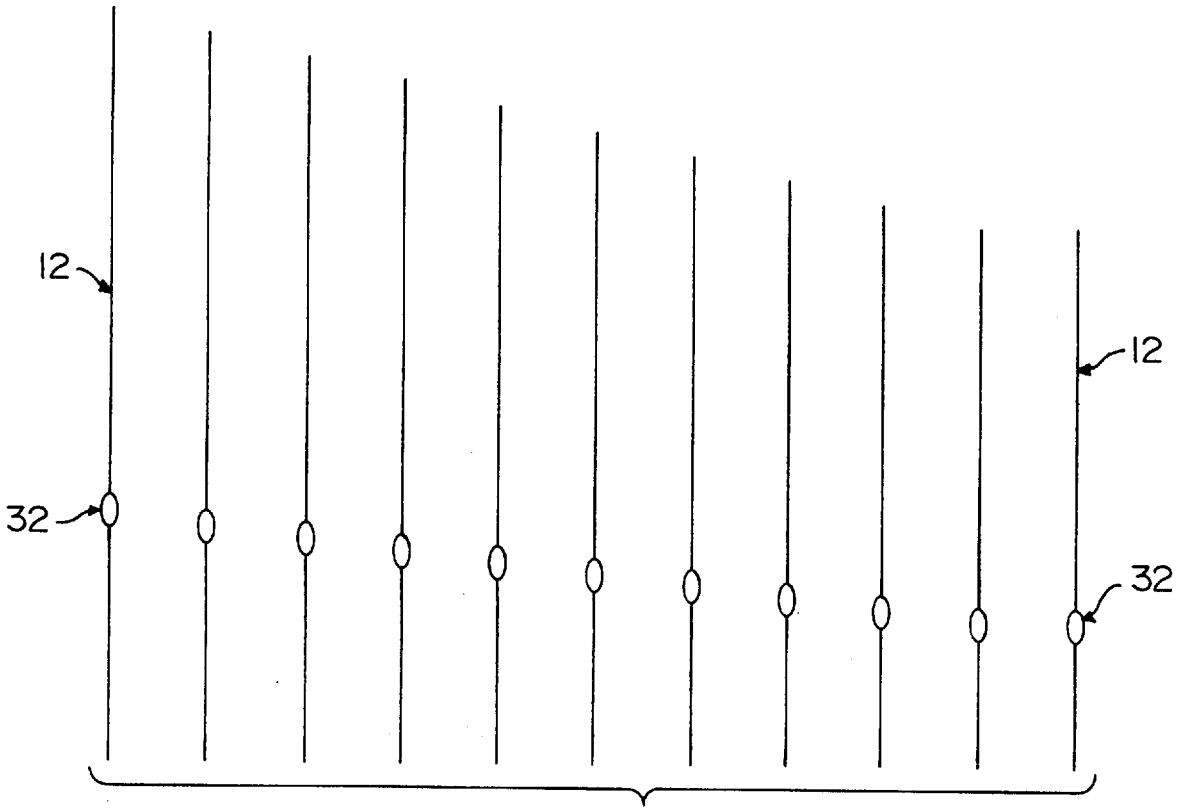
FIG. 5 is a diagram showing representations of the shafts of a set of golf clubs with the shaft of each club having a bulge formed thereof in accordance with certain principles of the invention to match the clubs of the set for consistent torsional performance.

As shown in FIG. 5, the presence and selective arrangement of the elements of the bulge 32 in a set of shafts 12 assist in the performance optimization of the individual clubs within the related set of golf clubs. In a matched set of golf clubs, each head exhibits unique dynamic characteristics. The moment of inertia and, consequently, the torsional requirements of each head within the set are different from each other. The bulge 32 and its positioning on the shaft 12 serve to address the torsional requirement of each head and normalize the torsional stability of each individual club within the set. This results in the matching of each club within the set from a torsional standpoint.

The presence of the bulge 32 in the shaft 12 serves to segment the shaft from a flexural standpoint. The bulge 32 allows different combinations of flexural stiffness in the portions of the shaft 12 between the bulge and the butt end 20 on the one side, and the bulge and the tip end 24 on the other side. The combining of different flexural stiffnesses with the shaft 12 contributes to a particular golf shot trajectory, depending on the combination used. For example, if the shaft 12 is designed with both of the above-noted portions being flexible, the resultant golf shot trajectory would be higher than if the shaft was designed with both portions being fairly stiff or rigid. In accordance with the principles of this invention, the bulge 32 allows several permutations of this concept in order to optimize both the golf ball launch angle when struck with the golf club 10 and the resultant trajectory of the golf ball.

It is noted that, in the drawings, some of the structural features have been drawn out of proportion for illustration purposes only. Actual structural configurations can be readily determined by virtue of the dimensions shown in the drawings.

In general, the above-identified embodiment is not to be construed as limiting the breadth of the present invention. Modifications, and other alternative constructions, will be apparent which are within the spirit and scope of the invention as defined in the appended claims.

What is claimed is:

1. A golf club shaft, which comprises:

a body composed of a non-metallic material extending longitudinally along an axis thereof;

the body formed with a butt end formed at one end thereof having an inboard extremity of a prescribed diameter and an outboard extremity;

the body formed with a tip end formed at an end of the body axially opposite the butt end and spaced axially therefrom and having an outboard extremity and having an inboard extremity of a diameter less than the prescribed diameter;

the body formed with an intermediate section which extends from the inboard extremity of the butt end toward the tip end wherein the diameter of an end of the intermediate section which joins the butt end is the same as the prescribed diameter and the diameter at an opposite end of the intermediate section is less than the prescribed diameter;

the body formed with a bulge along the axis of the body;

portions of the body immediately adjacent the bulge formed by the non-metallic material extending outward from a location in the immediate vicinity of the axis for a first prescribed distance from the axis to an outer surface of the portions of the body; and the bulge formed by the non-metallic material extending outward from a location closer to the axis than the outer surface of the immediately adjacent portions of the body for a second prescribed distance, greater than the first prescribed distance, from the axis to an outer surface of the bulge.

2. The golf club shaft as set forth in claim 1, wherein the bulge is formed with an axial opening therethrough having a wall which is circular at any transaxial section thereof and which is straight from an inboard end of the bulge to an outboard end thereof.

3. The golf club shaft as set forth in claim 1, wherein the bulge is formed in the tip end.

4. The golf club shaft as set forth in claim 1, wherein the bulge is formed in the intermediate section.

5. The golf club shaft as set forth in claim 1, wherein the bulge is formed partially in the tip end and partially in the intermediate section.

6. The golf club shaft as set forth in claim 2, wherein the opening formed axially through the bulge is tapered inward toward the axis of the body from the inboard end to and outboard end of the bulge.

7. The golf club shaft as set forth in claim 2, wherein the diameter of the opening of the bulge is less than the diameter of any external portion of the body immediately adjacent the bulge.

8. The golf club shaft as set forth in claim 1, wherein the bulge is formed by a composite material including non-metallic fibers and a cured plastic matrix.

9. The golf club shaft as set forth in claim 6, wherein the composite material of the bulge extends radially from the opening of the bulge to an exterior surface thereof.

10. The golf club shaft as set forth in claim 1, wherein the body is formed with an axial opening which extends through the body and which is tapered inward toward the axis of the body from the outboard extremity of the butt end to the opposite end of the body.

11. The golf club shaft as set forth in claim 1, wherein the non-metallic material is a composite material formed by nonmetallic fibers and a cured plastic matrix.

12. The golf club shaft as set forth in claim 11, wherein the non-metallic fibers are composed of graphite and the cured plastic matrix is a cured epoxy resin.

13. A golf club, which comprises:

a shaft having a body composed of a non-metallic material extending longitudinally along an axis of the body;

the body formed with a butt end formed at one end thereof having an inboard extremity of a prescribed diameter and an outboard extremity;

the body formed with a tip end formed at an end thereof axially opposite the butt end and spaced axially therefrom and having an inboard extremity of a diameter less than the prescribed diameter and an outboard extremity;

the body formed with an intermediate section which extends from the inboard extremity of the butt end toward the tip end wherein the diameter of an end of the intermediate section which joins the butt end is the same as the prescribed diameter and the diameter at an opposite end of the intermediate section is less than the diameter of the inboard extremity of the butt end;

the body formed with a bulge along the axis of the body;

portions of the body immediately adjacent the bulge formed by the non-metallic material extending outward from a location in the immediate vicinity of the axis for a first prescribed distance from the axis to an outer surface of the portions of the body;

the bulge formed by the non-metallic material extending outward from a location closer to the axis than the outer surface of the immediately adjacent portions of the body for a second prescribed distance, greater than the first prescribed distance, from the axis to an outer surface of the bulge;

a grip assembled on the butt end of the body; and a club head assembled on the tip end of the body.

14. The golf club shaft as set forth in claim 13, wherein the bulge is formed with an axial opening therethrough having a wall which is circular at any transaxial section thereof and which is straight from an inboard end of the bulge to an outboard end thereof.

15. The golf club as set forth in claim 13, wherein the diameter of the opening of the bulge is less than the diameter of any external portion of the body immediately adjacent the bulge.

16. The golf club as set forth in claim 13, wherein the bulge is formed by a composite material including non-metallic fibers and a cured plastic matrix.

17. The golf club as set forth in claim 14, wherein the composite material of the bulge extends radially from the opening of the bulge to an exterior surface thereof.

18. The golf club shaft as set forth in claim 13, wherein the non-metallic material includes graphite fibers and a cured epoxy resin.

* * * * *